United States Patent [19]

Galluzzi

[11] 4,236,451

[45] Dec. 2, 1980

[54] SELF-PROPELLING PROJECTILE FOR FIREARMS

[75] Inventor: Giovanni Galluzzi, Lecco, Italy

[73] Assignee: Giulio Fiocchi, S.p.A., Lecco, Italy

[21] Appl. No.: 934,606

[22] Filed: Aug. 17, 1978

Related U.S. Application Data

[63] Continuation of Ser. No. 816,915, Jul. 19, 1977, abandoned, and Ser. No. 626,352, Oct. 28, 1975, abandoned.

[30] Foreign Application Priority Data

May 31, 1971 [IT] Italy ..... 25246 A/71
Nov. 30, 1971 [IT] Italy ..... 31868 A/71

[51] Int. Cl.[2] ..... F42b 5/02

[52] U.S. Cl. ..... 102/38 RA; 89/135;

[58] Field of Search ..... 102/38 R, 38 RA, 38 CC, 102/45, 49.3, 46, 49.7; 86/1; 89/135

[56] References Cited

U.S. PATENT DOCUMENTS

| | | | |
|---|---|---|---|
| 750,623 | 1/1904 | Edmunds | 102/38 RA |
| 1,446,711 | 2/1923 | Ludorf | 102/49.7 |
| 1,468,822 | 9/1923 | Ludorf | 102/49.7 |
| 2,350,556 | 6/1944 | Hotchkiss | 86/10 |
| 2,424,934 | 7/1947 | Kasper | 102/49.7 |
| 2,462,135 | 2/1949 | Skinner | 102/46 X |
| 2,632,391 | 3/1953 | Kintzinger | 102/38 R |
| 2,922,341 | 1/1960 | Treat, Jr. | 102/45 |
| 3,504,629 | 4/1970 | Mack, Jr. | 102/38 CC |
| 3,505,927 | 4/1970 | Driscoll | 89/135 |
| 3,688,697 | 7/1969 | Paul et al. | 102/38 CC |

FOREIGN PATENT DOCUMENTS

| | | | |
|---|---|---|---|
| 1453092 | 2/1969 | Fed. Rep. of Germany | 102/49.7 |

*Primary Examiner*—Harold Tudor
*Attorney, Agent, or Firm*—Ralph W. Kalish

[57] ABSTRACT

A self-propelling projectile comprising a projectile body at the normally forward end of said projectile, a propellent charge at the normally rearward end of said projectile, and a primer element located between the ends of said projectile for ignition by side firing or percussion; there being means for maintaining said components in integrated relationship and with communication between said primer elements and said propellent charge whereby upon explosion of said propellent charge the force of the latter will be directed against the base of the projectile body.

3 Claims, 13 Drawing Figures

SELF-PROPELLING PROJECTILE FOR FIREARMS

This is a continuation of application Ser. No. 626,352, filed Oct. 28, 1975, now abandoned, and application Ser. No. 816,915, filed July 19, 1977, now abandoned.

BACKGROUND OF THE INVENTION

The present invention relates in general to caseless ammunition and more particularly to a self-propelled projectile adapted for propulsion by means of combustion of a propellent charge at the base of the projectile.

Self-propelling projectiles heretofore known have been of the integrated self-contained type such as set forth in my copending patent application Ser. No. 42,854 filed June 2, 1970 upon an invention entitled "Self-Propelled Projectile For Firearms of Any Type". Such integrated projectiles despite their effectiveness have proven relatively unsatisfactory in production by reason of the necessity of interrelating the constituent components wherein relatively strict tolerances obtain. Furthermore, with such self-contained projectiles there is a certain sacrifice in versatility in that there is, perforce, a rigidity in the propulsive characteristics thereof as differentiated from projectiles being capable of manufacture with a multitude of predetermined propulsive characteristics. Thus, the present invention overcomes the fixedness heretofore accepted with self-propelling projectiles.

SUMMARY

It is therefore an object of the present invention to provide a self-propelling projectile which is constituted of an assembly of individual unique components capable of interrelation is a variety of manners but without diminution of the resultant propulsion characteristics.

It is another object of the present invention to provide a self-propelling projectile formed of three basic components relatively easily associable and being adapted for propulsion of the projectile element by combustion of the propellent charge at the base of such projectile.

It is a still further object of the present invention to provide a self-propelling projectile comprising essentially a projectile, a priming element adapted for side firing or percussion, and a propellent charge with the same being so related that the priming element will be disposed circumferentially of the ammunition and the propellent charge presented for propelling the projectile by expansion of combustion gases against its base.

It is another object of the present invention to provide a self-propelling projectile which is particularly adapted for ignition by a firing pin located within the side of the gun chamber thus obviating utilization of the currently accepted breech block-mounted firing pin.

It is a further object of the present invention to provide self-propelling projectiles of the type stated which are adapted for use with a wide range of gun calibers.

It is another object of the present invention to provide self-propelling projectiles of the type stated which are amenable to rapid, high volume, mass production in a most economical manner.

DESCRIPTION OF THE PRACTICAL EMBODIMENTS

Figure 1:
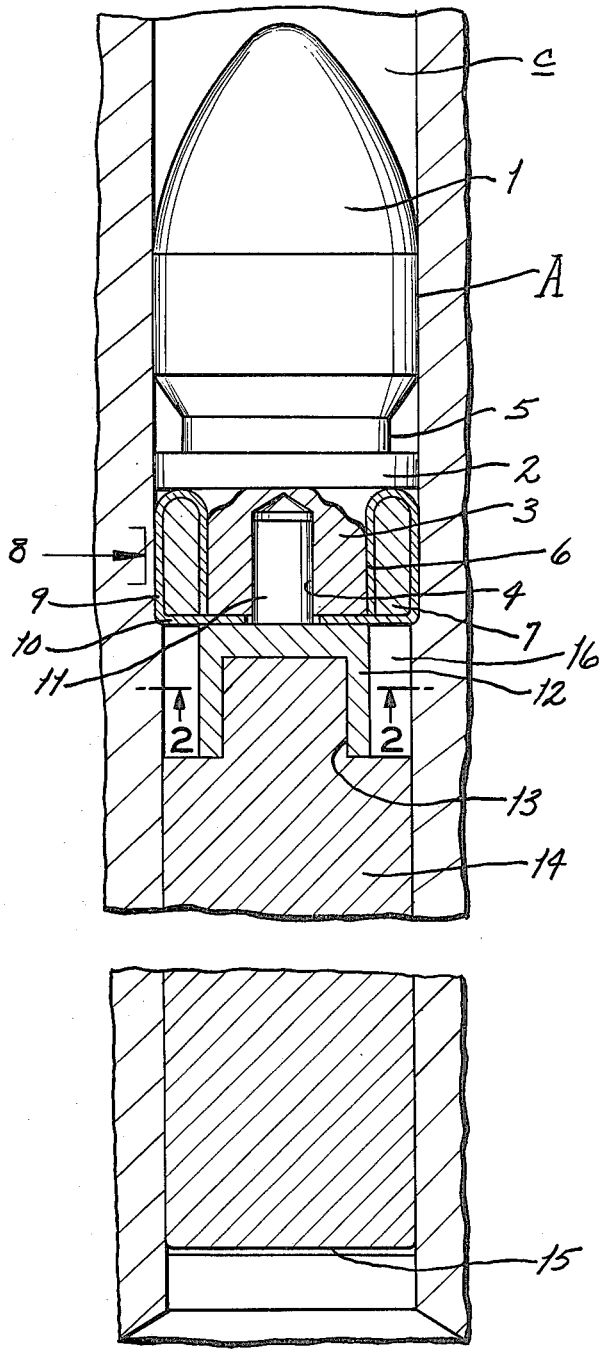
FIG. 1 is an elevational view, in partial section, of a self-propelling projectile constructed in accordance with and embodying the present invention illustrating the same as within the chamber of a firearm.

Referring now by reference characters which illustrate practical embodiments of the present invention, A generally designates a self-propelling projectile comprising a projectile body 1 of generally bullet-like character being of ogival contour with a base 2 from which a cylindrical tang 3 projects endwise; said tang is incorporating a normally rearwardly opening cylindrical recess or socket 4. Immediately forwardly of base 2 projectile body 1 is circumferentially knurled, as at 5, for facilitating extraction of projectile A from the chamber, as indicated at c, of the firearm in the event of misfire. Tang 3 is diametrically reduced with respect to base 2 for presenting an annular laterally opening recess 6 for receiving a priming element 7 of circular form for snug reception between said tang and the inner face of the side wall of chamber c; being so disposed for percussion by means of a firing pin (not shown) located within the side wall of chamber c as indicated broadly by an arrow at 8.

Figure 2:
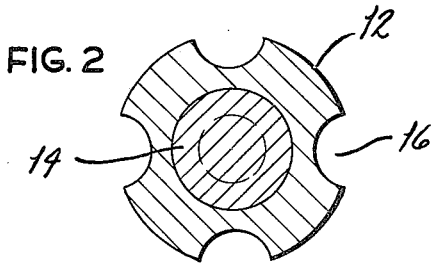
FIG. 2 is a horizontal transverse sectional view taken on the line 2—2 of FIG. 1.

Priming element 7 embodies a casing 9 for containing the priming mixture, which casing is fabricated preferably of paper or plastic material which is readily combustible or easily volatilizable for destruction upon ignition of the priming mixture; said casing 9 incorporates a base disc 10 which is planarwise parallel to base 2 of projectile body and abutting on its forward face against the rearward or lower surfaces of tang 3; there being a plug 11 associated with said disc 10 for reception within tang socket 4 by means of a jam fit or by threading to assure positive coupling of the projectile components as will be more evident from the following. Plug 11 on its rearward end is integral with a relatively short cylinder 12 being open at its lower or rearward end, as at 13, and having an outside diameter greater than that of the associated plug 11 but less than the inside diameter of firearm chamber c. Extending into cylinder 12 is the forward reduced end of the propellent charge 14, the body of which is of cylindrical form having an outside diameter substantially equivalent to the inside diameter of firearm chamber c and terminating at its rearward end proximate the closed end of said chamber c as indicated at 15. Propellent charge 14 can be comprised of any suitable material such as cordite, a nitrocellulose tube, and the like; with the same being of monolithic, rod-like character. Plug cylinder 12 incorporates a plurality of circumferentially spaced outwardly opening recesses or flash openings 16 (FIG. 2) which also are open at their ends for causing effective communication between the priming mixture 7 and the propellent charge 14.

It will accordingly be seen that the propellent charge 14 is entirely external of the projectile body 1 as opposed to the heretofore accepted concept of providing powder as within a bullet. Upon firing, the prime mixture 7 will be ignited and with the combustion being conducted through flash openings 16 to the propellent charge 14 for explosion of the latter. Thus, the gases of explosion will operate directly upon the base of projectile body 1 for propulsion of the same. Casing 9, together with disc 10, will be entirely dissipated upon ignition of prime mixture 7 to eliminate any dimunition in the explosion force accorded projectile body 1. It will be observed that plug 11, together with associated cylinder 12, serves merely to support prime element 7 in appropriate relationship to projectile body 1 and propellent charge 14 for effective operation.

Figure 3:
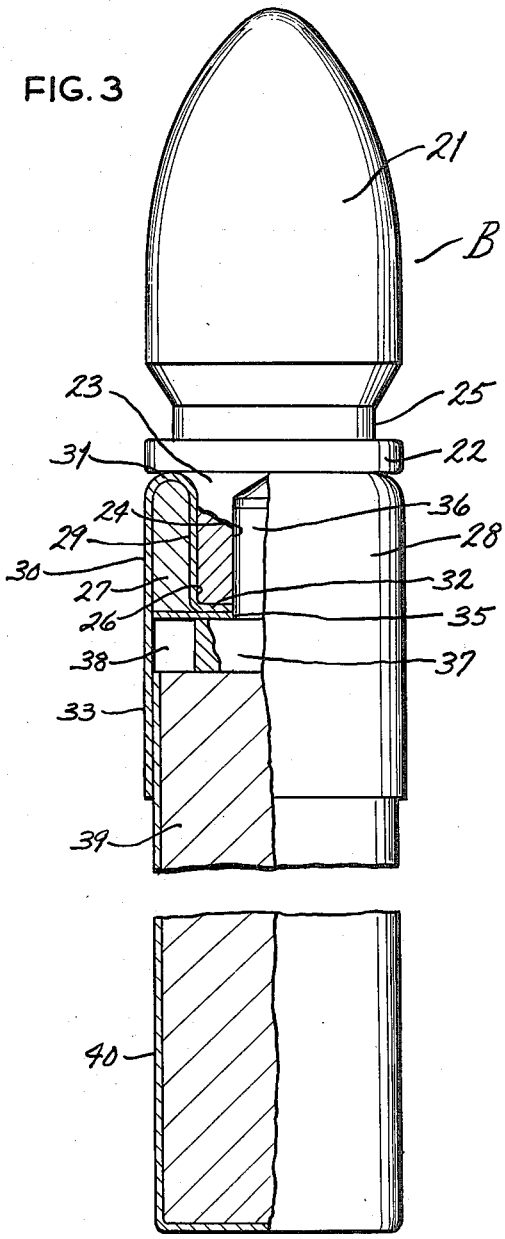
FIG. 3 is an elevational view, in partial section, of another form of self-propelling projectile constructed in accordance with and embodying the present invention.

Referring now to FIG. 3, B generally designates a self-propelled projectile having a projectile body 21 with a base 22 from which is diametrically reduced, cylindrical tang 23 extends endwise and also being provided with a centrally rearwardly opening recess 24; with said projectile body being knurled, as at 25, immediately forwardly of base 22. Surrounding tang 23, within the developed recess 26 is a priming element 27. All the aforesaid elements are substantially identical structurally and functionally with the corresponding components of projectile A described hereinabove. Priming element 27 is received within a metal container, indicated broadly 28, which embodies inner and outer planarwise parallel walls 29,30, respectively; the same being interconnected by an arcuate top wall 31. The inner wall at its rearward or lower end is turned inwardly to provide an annular flange 32, the central opening of which is aligned with recess 24. Outer wall 30 is of relatively extended length having a rearward skirt 33. Extending across the lower or rearward end of priming element 27 between walls 29 and 30 is a closure disc 34 having a central aperture 35 for registration with recess 24 and thus being in confronting relationship to flange 32. Said disc 34 is similar in all respects to disc 10 above discussed and is adapted for complete destruction upon ignition of the priming mixture. Presented for tight reception within recess 24 is a plug 36, as formed of metal, having an enlarged base 37 disposed rearwardly of disc 34; said base 37 being preferably cylindrical and having a diameter less than the inside diameter of skirt 33 of priming element wall 30 for developing spaced apart passages or flash openings 38 through which the ignited priming mixture may reach the propellent charge 39 provided within a casing 40; said latter being closed at its rearward end and opened at its forward end for presenting charge 39 directly against base 37 of plug 36; and with the outside diameter of casing 40 being substantially the same as the inside diameter of skirt 33 permitting of snug telescopic reception therein.

Upon ignition of priming element 27 by a firing pin located within the side wall of the firing chamber disc 34 will be dissipated and propellent charge 39 exploded for acting directly upon the base of projectile body 21.

Figure 4:
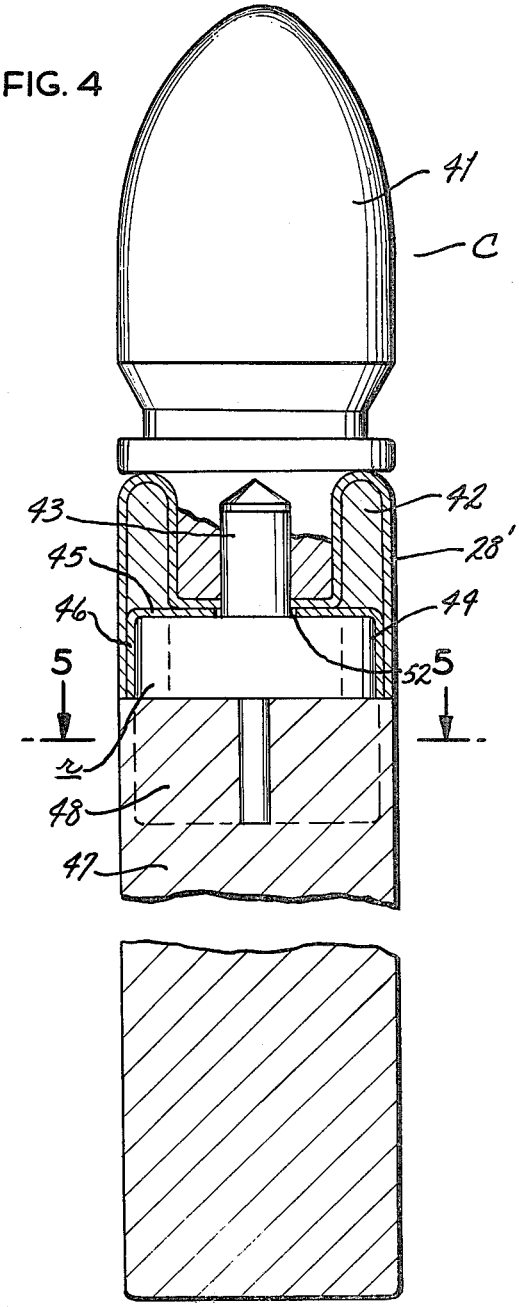
FIG. 4 is an elevational view, in partial section, of a further form of self-propelling projectile constructed in accordance with and embodying the present invention.
Figure 5:
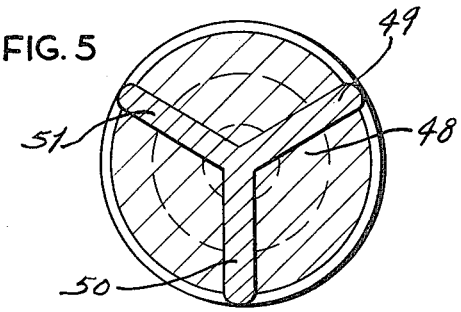
FIG. 5 is a horizontal transverse sectional view taken on the line 5—5 of FIG. 4.

Turning now to FIG. 4, C designates a self-propelled projectile having a projectile body 41 which conforms in all respects to projectile bodies 1 and 21 of projectiles A and B hereinabove described. Provided in projectile C is a priming element 42 which corresponds to priming element 27 of projectile B and is received within a casing 28' corresponding in all respects to casing 28 of projectile B. Snugly accepted within the tang socket of projectile body 41 is a plug 43 with the base of rearward end thereof being integral with a rearwardly opening cup-shaped body 44; said latter having a normally forward wall 45 extending across the lower end of priming element 42 and a rearwardly extending relative long annular flange 46. As indicated by phantom lines in FIG. 4, cup-shaped body 44 is contoured peripherally to provide a plurality of circumferentially spaced-apart lateraly opening passages r through which priming element 42 communicates with the propellent charge 47. The portion of the flange 46 beyond the upper end of propellent charge 47 is crimped or otherwise compressed to form a trilobate terminal indicated at 48 with the lobes or sections thereof being designated 49,50,51 (see FIG. 5) which interconnect at a point lying substantially upon the longitudinal axis of projectile C. Said trilobate terminal serves to effectively couple propellent charge 47 with priming element 42, which latter is suitably adjoined to projectile body 41 by plug 43 as well as to reinforce and rigidify propellent charge 47 in the direction of its major dimension.

The operation of projectile C is the same as projectiles A and B above described in that priming element 42 is ignited through percussion by side firing pin and combustion of propellent charge 47 is effected as cup-shaped body 44 is substantially instantaneously dissipated; it being also observed that flash openings, as at 52, are formed within cup body wall 45.

With respect to projectiles A, B, and C, percussion by the side firing pin produces ignition of the priming mixture with suitable combustion of the propellent charge thereupon. At such particular stage the related projectile body 1, 21, or 41, as the case may be, together with all of the remaining portions of the priming element and the associated plug, 11, 36, or 43, is propelled through expansion of the combustion gas of the associated propellent charge within the firearm barrel. Both the firing chamber and the barrel of the gun after firing remain free from any elements or residues of the projectile as all components of the charge have volatilized, including casing 40 of projectile B, and as all other constituents of the projectiles have been expelled.

Projectiles of the character above described may be manufactured in a most inexpensive manner, as the various parts are of simple construction and the assembly thereof may be easily achieved without the utilization of complex, costly machinery or highly skilled personnel. In addition, and of extreme criticality is the fact that projectiles of the present invention conduce to a versatility which has not been heretofore attainable with known constructions. Thus, with a definite projectile of predetermined weight, dimensions and shape, innumerable priming elements and propellent charges may be used so as to vary, within the desired limits, the propulsion characteristics of the projectile. For every projectile of a given caliber and weight, a vast range of ammunition may be obtained through altering the propellent charge and/or the priming element so as to adapt the ammunition to a specific use for the peculiar requirements of a user. Priming elements and propellent charges suitable for a certain type of projectile body can be used with equal efficiency with different projectile bodies. Accordingly, with but a limited number of components amenable to mass production, a multiplicity of different types of ammunition may be produced with facility.

The above described projectile bodies incorporate propellent charges such as 15, 39, and 47 which have an outside diameter equal to, or slightly less than, that of the projectile body base.

Figure 6:
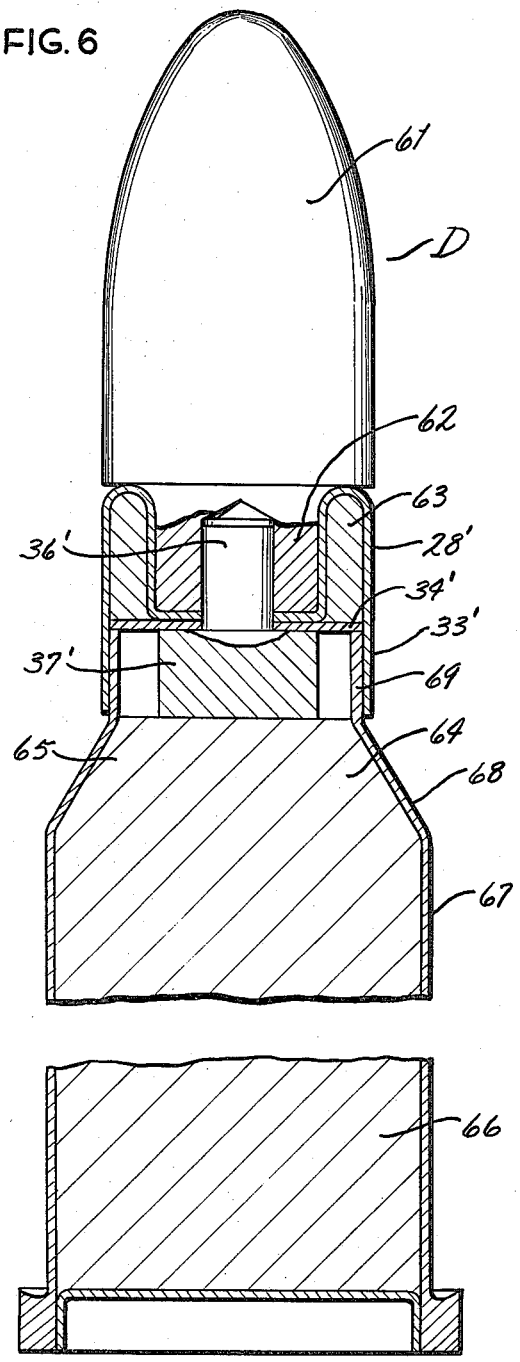
FIG. 6 is an elevational view, in partial section, of a still further form of self-propelling projectile constructed in accordance with and embodying the present invention.

Referring now to FIG. 6 another form of projectile indicated D is illustrated which embodies a projectile body 61 having a diametrically reduced centrally recessed tang 62 with a priming element 63 surrounding said tang 62 and being received within a container 28' being in all respects structurally similar to container 28 above described in conjunction with projectile B, but wherein the outer skirt 33' is of slightly less length. A disc 34' which is of like construction as disc 34 above described is disposed against the rearward end of the priming mixture and a plug 36' is tightly received within the tang 3; there being a diametrically enlarged base 37' with the rearward end of plug 36'; the latter corresponding structurally and functionally to base 37' above described. The rearward end of base 37' abuts against the forward end face of a propellent charge 64, the forward end of which is of truncated conical configuration, as at 65, and with the rearward major portion indicated at 66 of relatively increased diameter, being of greater cross section than the associated projectile body 61. Said propellent charge 66 may be received within a casing 67 which is shaped to conform to the contour of charge 66 whereby said casing will be tapered inwardly in its forward portion, as at 68, for continuity with an end neck 69 which is snuggly received within skirt 33' and with the forward end edge abutting against the confronting surface of disc 34'. Casing 67 may be formed of combustible material so that upon firing, the gun chamber will be freed of any residue, or if desired, may be formed of metal for ease of extraction after firing.

Figure 7:
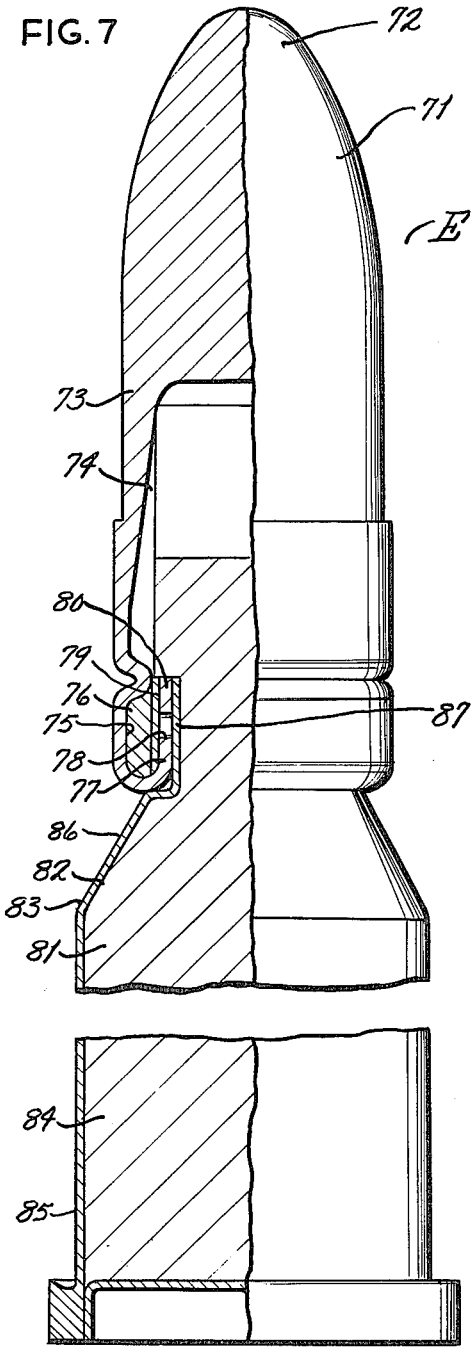
FIG. 7 is an elevational view of an additional form of self-propelling projectile constructed in accordance with and embodying the present invention.

Referring now to FIG. 7 E designates a further form of self-propelled projectile formed in accordance with the present invention which comprises a projectile body 71 which constitutes a solid forward or nose portion 72 and an elongated rearwardly extending skirt 73 for defining a rearwardly opening cavity 74. In its end portion said skirt 73 is contoured by inward turning of its edge to form an annular pocket 75 for receiving the priming element 76, which pocket opens inwardly; said pocket embodying an up turned inner edge portion 77, the upper margin of which provides a lower limit of a continuous circular flash opening 78 for communication with the interior of said pocket for purposes presently appearing. Presented for closure of pocket 75 is an annulus 79 fabricated preferably of paper or like combustible or like evanescent material being thus structurally and functionally similar to disc 10 above described. Said annulus 79 abuts on its inner face against the outer face of edge portion 77 and the outer face of a ring-like spacer 80, the lower edge of which provides the upper limit of flash opening 78; said latter being thus normally closed by annulus 79. Extending into cavity 74 is the forward extension of a propellent charge 81, the forward end face of which terminates immediately adjacent the end wall of cavity 74; said charge beyond the rearward end of projectile body 71 flaring rearwardly and outwardly, as at 82, laterally of the side face of projectile body 71, as at 83, and with its major portion 84 continuing rearwardly being of constant diameter whereby said last mentioned portion will be of greater caliber than projectile 71. Propellent charge 81 may be received within a casing 85 which commensurately tapers inwardly, as at 86, for accommodating the flared portion 82 of said charge 81 and therefrom is provided with a neck 87 for extension into the rearward portion of cavity 74, with its forward end edge terminating substantially in alignment with the forward end of pocket 75. Neck 87 on its outer surface abuts against the inner face of edge 77 and spacer 80, thus extending across flash opening 78. Casing 85 may be fabricated of either combustible material for consumption upon firing or of metallic character. If said casing 85 is formed of metallic character then the portion thereof confronting flash opening 78 will be provided with suitably spaced apart apertures or vents for registration with said flash opening to permit of direct communication between priming element 76 with propellent charge 81 after ignition of the former as by a side firing pin. If casing 85 is fabricated of combustible material then the presence of such apertures is not requisite for such communication. It is of course understood that skirt 73 within pocket 75 is suitably provided to permit effective contact between the firing pin and the priming element 76, as by openings, attenuations in certain zones of the skirt, etc.

It will be seen that the forms of the invention as embodied within projectiles D and E permit of a relatively increased propellent charge, as with respect to projectiles A, B, and C hereinabove described and one wherein the diameter of such charge is substantially greater than that of the associated projectile body.

Figure 8:
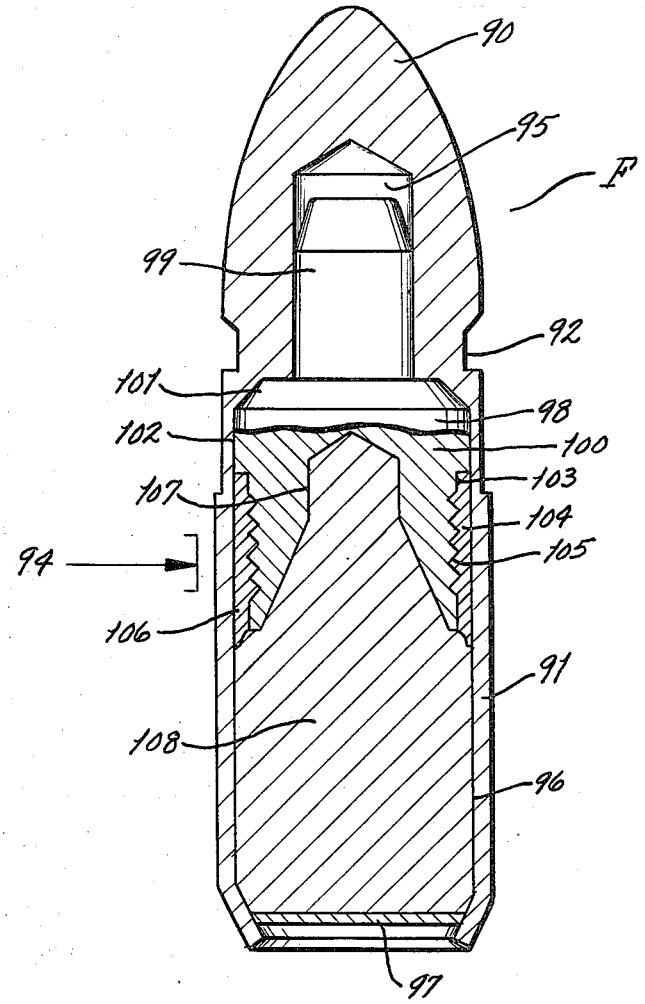
FIG. 8 is an elevational view, substantially in section, of another form of self-propelling projectile constructed in accordance with and embodying the present invention.

Referring now to FIG. 8, F designates a still further form of self-propelled projectile formed in accordance with the present invention which comprises unitarily a solid forward portion or nose 90 and a rearward casing-forming portion 91. Nose 90, which is of ogival form contains a knurled neck, as at 92, wherefrom said casing 91 extends with the wall 93 thereof being of relatively reduced thickness for providing ample strength for integrity of the projectile F while permitting of requisite indentation when subjected to a laterally disposed firing pin, as indicated at 94. Internally, nose 90 is provided with a central rearwardly opening cavity 95 for normal communication with the chamber 96 defined by casing 91; said casing 91 at its rearward end is closed as by a combustible disc 97 which may be suitably threaded for waterproofing.

Presented interiorally of nose 90 and casing 91 is an intermediate body 98 which reinforces said projectile F and serves to integrate the components thereof. Body 98 incorporates at its forward end a plug 99 for snug reception within cavity 95 and a diametrically increased base 100 presented within the forward or nose-adjacent portion of casing chamber 96. Said base 100 includes a tapered shoulder 101 complementary to the contour of the forward end of chamber 96 and immediately rearwardly of said shoulder 101, as at 102, is of such diameter as to be tightly engaged with the inner face of wall 93. In its rearward or terminal portion, intermediate body base 100 is reduced diametrically, as at 103, for developing an annular volume 104 between the outer face thereof and the confronting inner face portion of casing wall 93; said volume 104 being formed to provide a plurality of circumferentially extending corrugations or coarse threading, as at 105, for purposes presently appearing. Received within volume 104 is an annular primer element 106 as being formed of a composition having a plasticity for taking a firm set responsive to application of mold-like surfaces, said primer element 106 is introduced into volume 104 when in a plastic state whereby the same will conform to the surfaces bordering said volume with such material intimately abutting corrugations 105. Thus upon drying said primer element 106 will harden and through an inherent cementious character reliably be retained in position. Said base 100 is centrally provided with a rearwardly opening recess, as at 107, continuous with chamber 96 so as to provide maximum volume for receiving a propellent charge, as indicated at 108.

It will thus be seen that upon operation of firing pin 94 primer element 106 will be ignited and with propellent charge 108 being thereby exploded. It is to be observed that corrugations 105 serve as anvils for the firing pin to assure of proper ignition of the intervening primer element 106; but with the plurality of such corrugations 105 providing a versatility in that a precise disposition of projectile F with respect to the firing pin 94 is not necessary. In view of the foregoing it will be seen that projectile F is fully self-contained; that the same permits of obvious ease of assembly; and that it assures of effective firing without precision in alignment of the projectile and the firing pin. Manifestly, the components of projectile F may be so dimensioned for an extensive variety of calibers.

Figure 9:
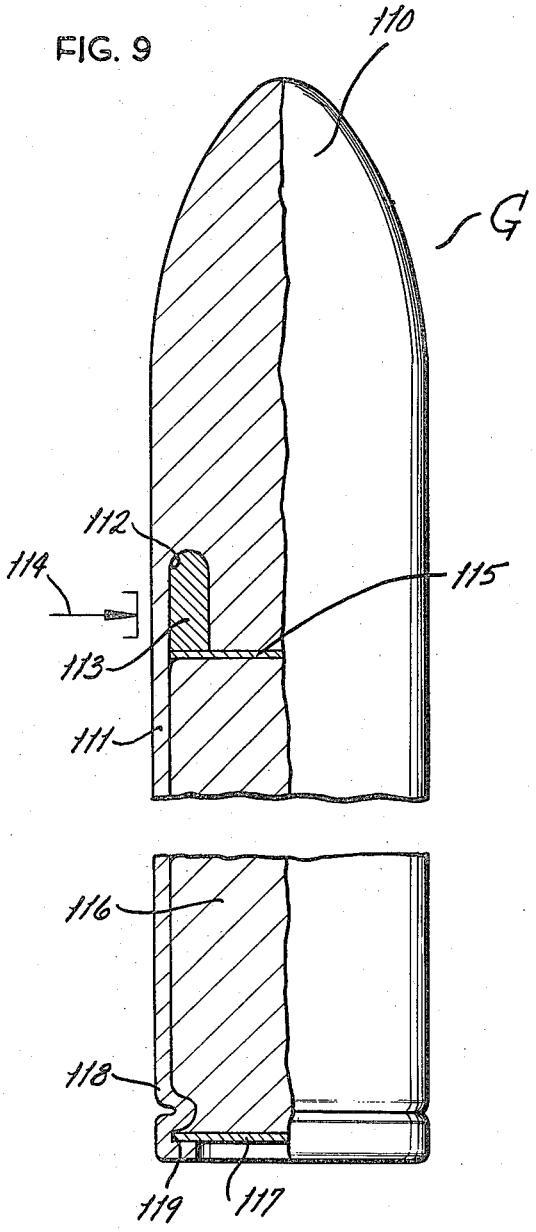
FIG. 9 is an elevational view, in partial section, of an additional form of self-propelling projectile constructed in accordance with and embodying the present invention.

Referring now to FIG. 9, G designates another form of self-propelling projectile formed in accordance with the present invention which is of one-piece character, unitarily comprising a solid forward portion or nose 110 of ogival form and a rearward casing-forming portion 111. Formed in the base of nose 110 is an annular, rearwardly opening recess 112 for receiving a primer 113, being of suitable mixture and thus presented for ignition by side percussion, as by a firing pin, schematically indicated by an arrow 114. Primer 113 is maintained within recess 112 by means of a disc 115, as of paper or the like, which effectively closes the normally opened end of recess 112 and abuts against the rearward end face of nose 110. Said disc 115 is maintained against inadvertent or premature displacement by means of varnish. Filling casing 111 is a propellent charge 116 which in its forward end abuts against the rearward face of disc 115 and in its rearward end bears against a closure disc 117, as of paper, which effectively closes the normally opened rearward end of projectile G. It will be observed that the end portion of casing wall 118 is contoured to create an annular groove 119 for setting therein of the edge portion of disc 117 and with the latter being also sealed by varnish. Thus, propellent charge 116 is appropriately protected by disc 117 against undesired exposure to the atmosphere or to inadvertent loss.

Figure 10:
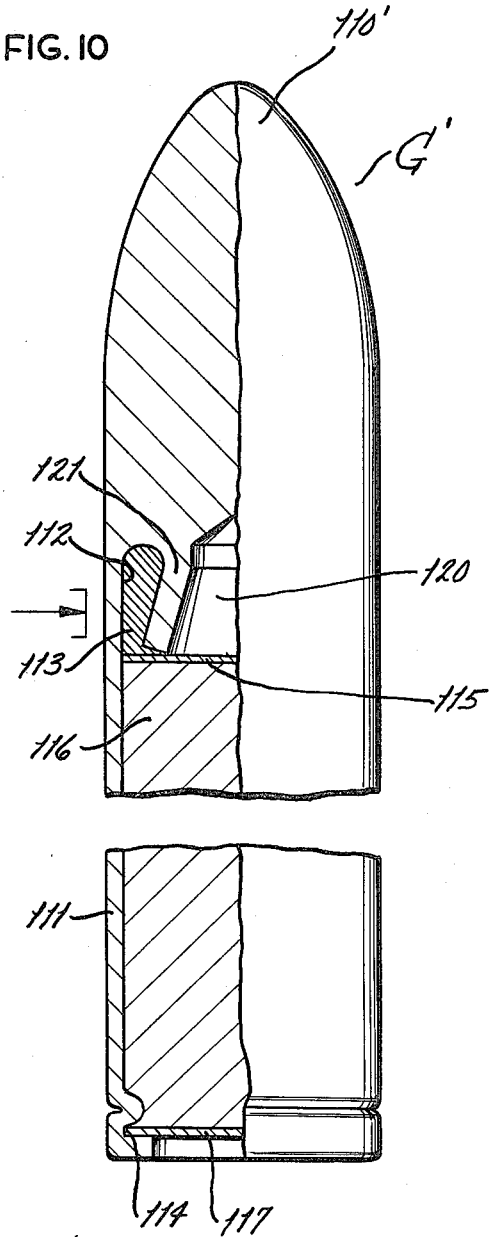
FIG. 10 is an elevational view, in partial section, of a further form of self-propelling projectile constructed in accordance with and embodying the present invention.

Referring now to FIG. 10, G′ designates a self-propelling projectile which is a fundamentally similar character to projectile G hereinabove described so that like reference numerals will relate to like components. Said projectile G′ is also of one-piece unitary character comprising a solid forward portion or nose 110′ of ogival form and a rearward casing-forming portion 111. Centrally of its base portion nose 110′ is provided with a socket-like portion 120 having an annular wall 121 between same and recess 112. Said wall 121 is bent or turned generally radially outwardly for compressing primer 113 within recess 112. Such compression of primer 113 while conducing to the increased security of primer 113 against displacement also substantially increases the sensitivity of the same to percussion.

Figure 11:
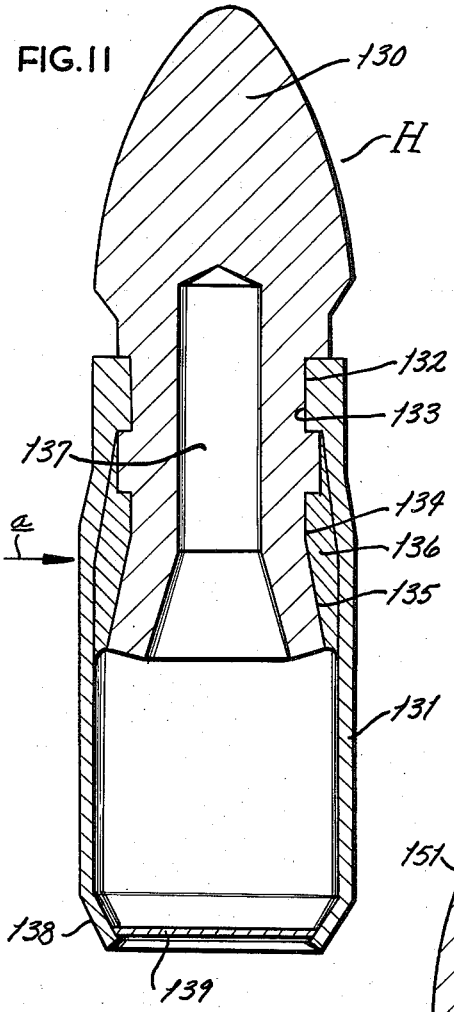
FIG. 11 is an elevational view, in section, of a still further form of self-propelling projectile constructed in accordance with and embodying the present invention.

Referring now to FIG. 11, H generally designates a self-propelling projectile of generally two-piece character embodying a solid forward or nose portion 130 and a case-forming member 131 of generally tubular form. Said nose 130 is engaged by means of the interfit between a circumferential groove 132 substantially centrally of nose 130 and a radially inwardly extending complementary projection 133 provided on casing member 131. Said nose 130 extends a substantial distance within casing 131 and being externally relatively reduced for developing an annular recess 134 between same and the interface of the wall of casing 131. As seen in FIG. 11, the exterior lateral surface of nose 130 inclines outwardly in a flaring manner, as at 135, at its rearward end to cause recess 134 to be relatively widened in its central portion for enhancing the reliable maintenance therein of a priming mixture 136 which is radially compressed by the flaring 135 of nose 130.

Opening through the base of nose 130 is a relatively extensive axial recess 137 communicating with the interior of casing 131 so that said recess 137 and casing 131 may combine to contain the propellent charge (not shown). The rearward end of casing 131 tapers inwardly, as at 138, in a general conical reduction and with the normally opened end of casing 131 being effectively closed by paper disc 139 fitted within the tapered end 138 and being sealed as by means of varnish. Thus, projectile H maintains a snug joint between nose 130 and casing 131 and presents priming mixture 136 in a compressed state for enhanced sensitivity in ignition by side firing as indicated by arrow a.

Figure 12:
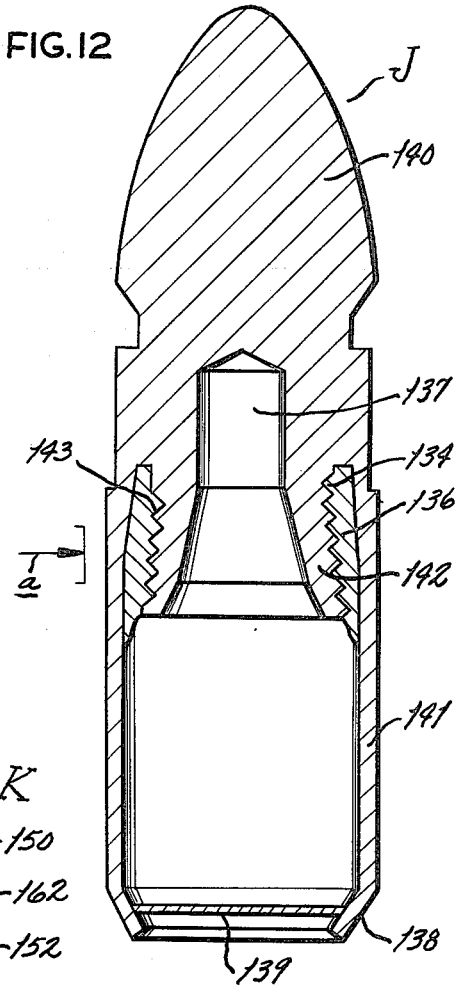
FIG. 12 is an elevational view, in section, of another form of self-propelling projectile constructed in accordance with and embodying the present invention.

Turning now to FIG. 12, projectile J is of one-piece construction being basically similar to projectile H above described, but different therefrom in that its forward portion or nose 140 and its rearwardly extending casing portion 141 are unitarily formed as distinguished from the two-piece construction of projectile H. With this distinction in mind, like reference numerals will be utilized to refer to like components. It will be seen that the rearward portion of nose 140, as at 142, within casing portion 141 generally flares outwardly toward its rearward end for compressing priming mixture 136. However, the exterior surface of such portion is of corrugated character, as at 143, for increasing the stability of priming mixture 136 within recess 134 as well as presenting a series of anvil-type surfaces for assuring of requisite ignition through side firing.

Figure 13:
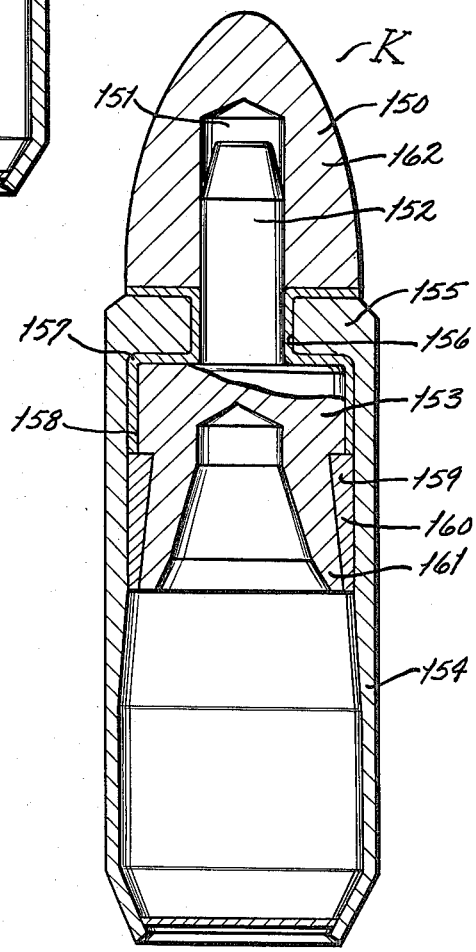
FIG. 13 is an elevational view, in partial section, of an additional form of self-propelling projectile constructed in accordance with and embodying the present invention.

Referring now to FIG. 13, K designates another form of self-propelling projectile constructed in accordance with this invention comprising a forward portion or nose 150 of of ogival form and having a rearwardly opening axial bore constituting a tang socket 151 for accepting, as by means of a jam fit, a plug 152 extending from the forward end of a generally cylindrical connector 153. Surrounding connector 153 is a generally tubular casing 154 which at its forward end is provided with a radially inwardly extending portion 155 having a central opening 156 in surrounding relationship to the confronting portion of plug 152; said opening being of slightly relatively greater diameter. Provided between the confronting surfaces of extending portion 155 and the rearward end face of nose 150, and the forward face of cylinder 153 is an electrical insulator 157 which also is disposed between plug 152 and said extending portion 155 as well as between the facing portions of casing 154 and cylinder 153, as at 158. It will thus be seen that nose 150 and casing 154 are uniquely integrated by means of plug 152 with its associated cylinder 153 and with the said components being mutually insulated, one from the other, except by the contact between plug 152 and nose 150.

The lower portion of cylinder 153 is of slightly relatively reduced diameter to cooperate with the adjacent inner face of casing 154 to define a recess 159 for receiving a priming mixture 160. Said mixture 160 is compressed by reason of the outward flaring of said cylinder 153 in its rearward extremity, as at 161.

In addition to being a projectile of three-piece character, as distinguished from the embodiments immediately disclosed hereinabove, projectile K is uniquely adapted for firing through electricity. Nose 150 is provided with an electric contact zone, as at 162, for contact by a "hot" firing pin (not shown) which is suitably insulated from the related gun. As is evident, the chamber of the gun receiving projectile K is suitably grounded. Upon firing of the pin a circuit is established and with the current flowing through nose 150, plug 152, and cylinder 153 to priming mixture 160 which is thereby fired. It is to be understood that the priming mixture is of semi-conductive character. Thus, projectile K exemplifies a form of the invention adapted for side percussion, but within the primer is ignited electrically. With this form of the invention, the firing pin is not disposed for direct impact upon the primer through the casing wall.

Having thus described my invention, what I claim and desire to obtain Letters Patent for is:

1. A self-propelling projectile comprising a projectile body having a solid forward or nose portion of ogival form and a rearward cylindrical, casing-forming portion, said solid forward portion and said rearward casing-forming portion being integral, being of one-piece character, said casing-forming portion being hollow to define the relatively thin side wall of a chamber, the base of said nose portion defining the forward limit of said chamber, said casing-forming portion being normally opened at its nose-remote end portion, means for closing the nose-remote portion of said casing-forming portion for enclosing said chamber, a propellent charge provided in said chamber, there being a normally rearwardly opening, annular recess in the base of said nose, said recess being continuous and opening toward said chamber for normal communication therewith, the opposite or forward end of said recess being closed, the outer side of said annular recess constituting a continuous forward extension of said casing-forming portion side wall and being of substantially line thickness thereof whereby said recess is presented in the radially outward portion of said nose base, a priming mixture disposed in said recess, a disc disintegratable member extending transversely of said chamber in abutting relationship to the base of said nose portion and closing the normally open rearward end of said priming mixture-containing recess for confining said mixture therein, the portion of said nose inwardly of said recess being solid, whereby the relative location of the said recess and the relative thinness of said side wall presents the priming mixture for ignition by said percussion.

2. A self-propelling projectile as defined in claim 1 and further characterized by said disc member being maintained in position prior to ignition of said priming mixture by varnish.

3. A self-propelling projectile as defined in claim 1 and further characterized by said disc member being fabricated of paper.

* * * * *

UNITED STATES PATENT OFFICE

CERTIFICATE OF CORRECTION

Patent No. 4,236,451 Dated December 2, 1980

Inventor(s) Giovanni Galluzzi

It is certified that error appears in the above-identified patent and that said Letters Patent are hereby corrected as shown below:

Claim 1, Column 10, Line 24 "line" should be --- like---.

Claim 1, Column 10, Line 35 "said" should be --- side---.

Signed and Sealed this

*Seventh* Day of *April 1981*

[SEAL]

*Attest:*

RENE D. TEGTMEYER

*Attesting Officer* *Acting Commissioner of Patents and Trademarks*